United States Patent [19]

Ray

[11] 4,074,817

[45] Feb. 21, 1978

[54] BARGE CABLE CRANE

[76] Inventor: Louis F. Ray, P.O. Box 14702, Baton Rouge, La. 70808

[21] Appl. No.: 668,996

[22] Filed: Mar. 22, 1976

[51] Int. Cl.[2] ..... B63B 27/00; B66C 23/52

[52] U.S. Cl. ..... 214/13; 212/3 R; 212/48; 212/56; 212/63

[58] Field of Search ..... 212/63, 56, 3, 48–49; 214/13–15, 141

[56] References Cited

U.S. PATENT DOCUMENTS

| | | | |
|---|---|---|---|
| 734,974 | 7/1903 | Shoosmith | 212/56 |
| 1,193,587 | 8/1916 | Miller | 212/3 |
| 1,428,809 | 9/1922 | Zimmerman | 212/3 |
| 3,402,824 | 9/1968 | Zweifel | 212/81 |

FOREIGN PATENT DOCUMENTS

| | | | |
|---|---|---|---|
| 682,029 | 9/1929 | France | 212/3 |
| 19,166 of | 1893 | United Kingdom | 212/49 |
| 12,734 of | 1849 | United Kingdom | 212/56 |

*Primary Examiner*—Trygve M. Blix
*Assistant Examiner*—R. B. Johnson
*Attorney, Agent, or Firm*—Sughrue, Rothwell, Mion, Zinn and Macpeak

[57] ABSTRACT

A buoyant barge mounted crane has a vertical tower with a horizontal gantry. On the gantry is a cargo transfer assembly including a trolley and lift mechanism. A balance load is mounted on one end of the gantry, and the opposite end of the gantry is connected by a cable to a floating counterweight barge. As the trolley travels horizontally on the gantry, the counterweight barge maintains equilibrium of the crane through the transfer of weight through the cable.

5 Claims, 4 Drawing Figures

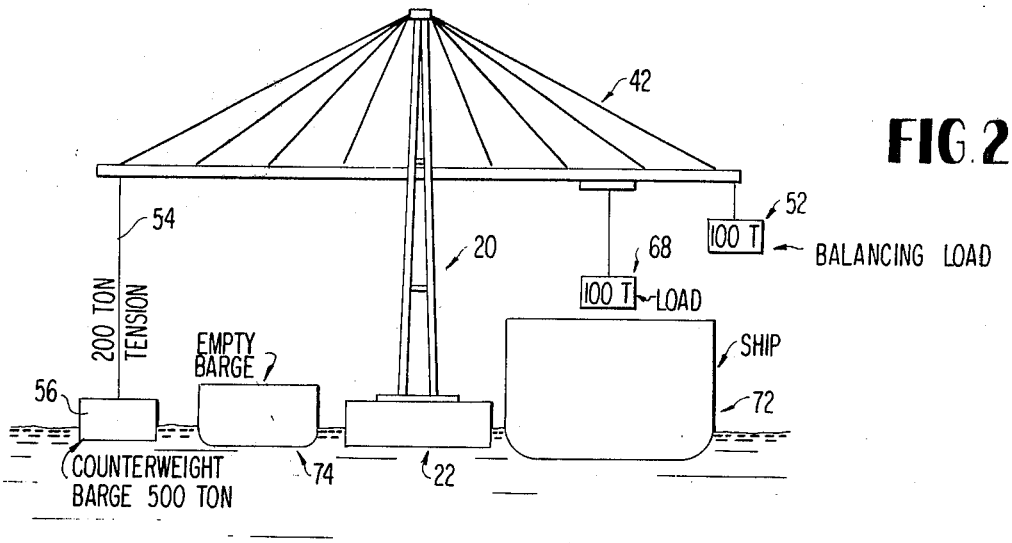
FIG. 2
FIG. 3
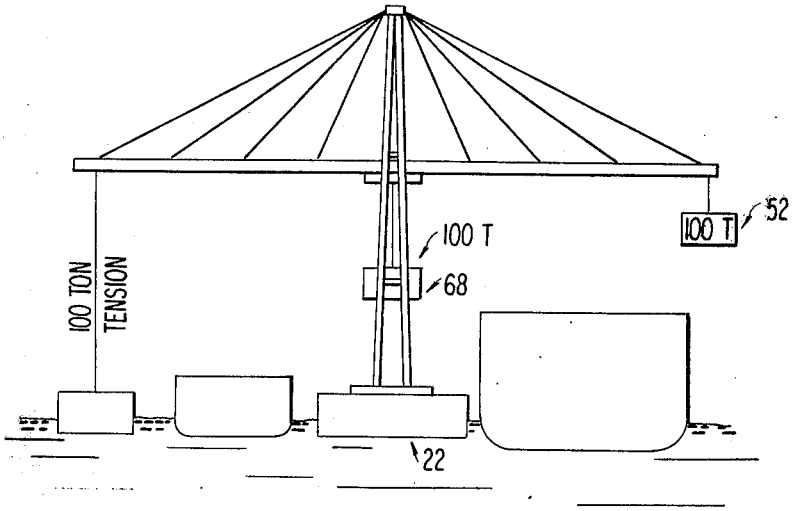
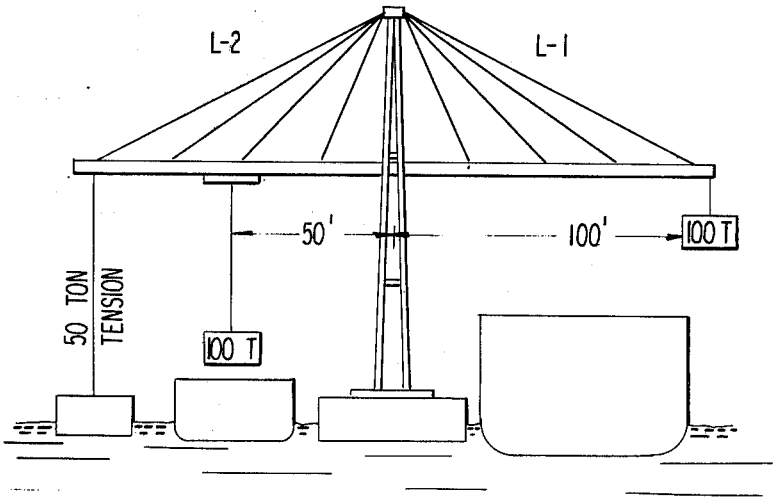
FIG. 4

BARGE CABLE CRANE

CROSS REFERENCE TO RELATED APPLICATIONS

This invention is related in structure and purpose to the inventions shown in my prior pending applications entitled CABLE STAY CRANE, filed Feb. 24, 1976, Ser. No. 661,063 and LOADING/UNLOADING CRANE WITH BUOYANT COUNTERWEIGHT SYSTEM, filed Mar. 5, 1976 Ser. No. 664,119.

BACKGROUND OF THE INVENTION

1. Field of the Invention

This invention pertains to waterborne lifting devices, and more particularly to means for prevention of overturning of such devices.

2. Statement of the Prior Art

Counterweight means for cranes have been previously proposed and utilized. Insofar as known, the present invention represents the first such device wherein a fixed counterweight load is compensated by a floating counterweight barge as cargo is transfered horizontally.

SUMMARY OF THE INVENTION

In the interest of safe and efficient operation of waterborne cranes, the present invention provides a tower extended from a floating barge and having a horizontal gantry thereon. The gantry has a fixed balance load at one end and at its opposite end it is attached via a cable to a floating counterweight barge. As downward forces are applied by the cargo to different longitudinal positions on the gantry, any overturn moments are compensated by the counterweight barge, or by the fixed balance load. A principal objective of the invention resides therefore in avoidance of accidental overturn of waterborne cranes. An ancillary objective is the improvement of efficiency of operation through a substantially automatic balancing system of such cranes, whereby interruption of operation for balancing procedures is rendered unnecessary.

Additional objects and advantages of the invention will become apparent to those skilled in the art from a consideration of the following specification when read in conjunction with the annexed drawings.

BRIEF DESCRIPTION OF THE DRAWINGS

FIGS. 2 through 4 are diagrammatic views showing sequences of operation.

DESCRIPTION OF THE PREFERRED EMBODIMENTS

Figure 1:
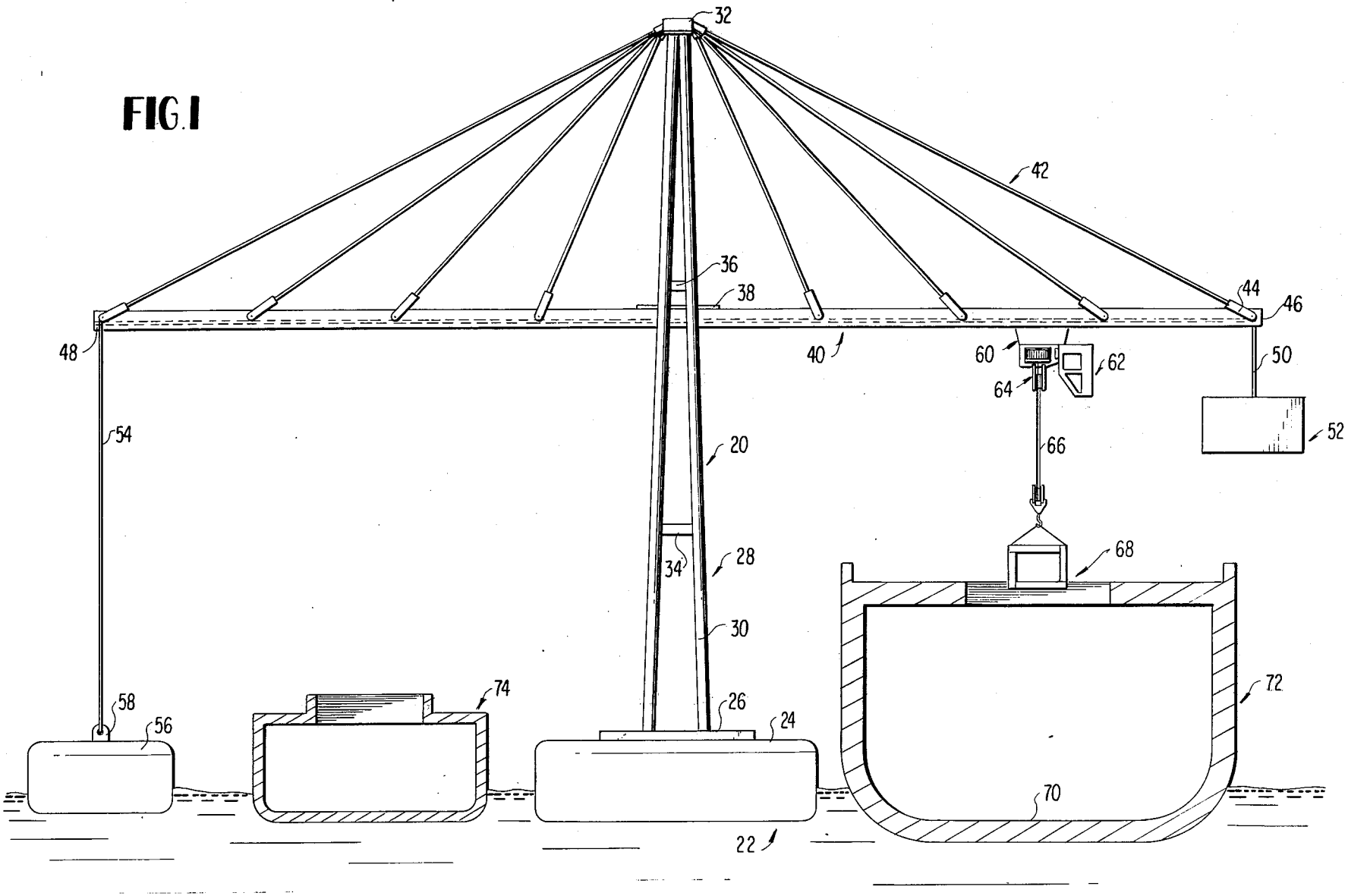
FIG. 1 is an elevational view, with certain components shown in cross-section, of the overall assembly hereof.

Referring to FIG. 1, a barge cable crane assembly according to this invention is therein generally identified by reference numeral 20. The operating components of the unit closely resemble, in structural detail, those of the aforesaid prior applications. These operating components form no part of the invention hereof, and are shown and described in general terms only herein. The crane 20 is mounted on a buoyant crane barge 22 having a top deck 24. On the deck 24 is a mounting plate 26.

The tower assembly 28 of the crane is composed of a plurality of columns 30 which extend in upwardly converging fashion from the plate 26 to a tower top portion 32. At vertically spaced positions, braces 34, 36 rigidify and interconnect the columns.

At a position intermediate the mounting plate 26 and the top portion 32, a gantry connector plate 38 is secured in horizontal position between the columns. Fixedly secured to, and suspended from, the connector plate 38 is an elongated gantry 40. The gantry 40 is also connected to the tower by a series of cable stays 42. The cable stays are secured to the gantry at laterally outwardly spaced positions on pivot clevises 44, and are also fixedly secured to the top portion. The gantry, for purposes of orientation herein, has opposite first and second ends 46, 48, respectively.

Suspended by a cable 50 from the first end 46 of the gantry is a balance load 52. The load 52 may comprise any relatively heavy substance, for example, a container filled with water—readily available in the intended environment of use of the invention apparatus.

On the second end 48 of the gantry is a cable 54 of predetermined, fixed length. The cable 54 is secured also to a counterweight barge 56 having a connector cable eye 58. It should be understood that the barge 56 is buoyant, and it is important also that its non-buoyant weight substantially exceeds the suspended weight of the balance load 52.

On the gantry 40 is a longitudinally movable trolley 60 with an operator's cab 62. A winch 64 has a lift cable 66 employed to engage cargo 68.

For purpose of description herein, and not by way of limitation, it will be assumed that the cargo 68 is to be lifted from the hold 70 of a ship 72 (a first location), and transfered to an unloading barge 74 (a second location). Here, the ship 72 is located between the crane barge and the balance load, and the unloading barge 74 is positioned between the counterweight barge and the crane barge.

Referring to FIG. 2 initially, if it is assumed that the load 52 is of a 100-ton weight and that the cargo 68 is similarly of 100-ton magnitude, as the cargo is engaged and lifted the tension applied to the cable 54 lifting the 500-ton counterweight barge as transmitted through the gantry and cable stays is 200 tons. In FIG. 3, the cargo has been transmitted by the trolley to a mid-length location on the gantry immediately over the crane barge 22. This lessens the tension on the cable 54 to one wherein it simply equals the weight on the balance load 52, that is, the counterweight barge returns to its buoyant status as determined by the length of the cable. Finally, in FIG. 4 it is noted that the cargo has now been moved to an unloading position over the barge 74, thus further reducing the tension on the cable 54 since the cargo itself tends to compensate for the extent of the balance load. The adjustment is substantially automatic as the movement of the cargo progresses from side to side.

I claimed:

1. A waterborne crane for transfer of cargo from a first location to a second location, the crane comprising:

a buoyant crane barge;

a crane tower mounted on the crane barge and extending vertically therefrom, the tower having a top portion and a base;

a gantry extending horizontally and being located on the tower intermediate the base and the top portion;

the gantry having first and second ends on opposite sides of said tower;

a balance load suspended on the first end of the gantry, the balance load being of a determined weight;

a buoyant counterweight barge, and a cable connecting the second end of the gantry thereto, the counterweight barge being of a weight substantially exceeding the weight of the balance load, and the cable being of a length such that the tension applied to the gantry at the second end is equal to the downward moment on the first end of the gantry applied by the balance load;

the first location of the cargo being below the gantry between the crane barge and the balance load, and the second location being below the gantry between the counterweight barge and the crane barge; and a movable trolley assembly on the gantry, including a lift mechanism, the lift mechanism engaging the cargo from the first location, elevating the cargo, moving it longitudinally, and depositing it at the second location, the tension on said cable connecting the second end of the gantry and the counterweight adjusting to the change in downward moment on the gantry occasioned by lift and movement of the cargo by virtue of the buoyancy of the counterweight barge.

2. The invention of claim 1, and:

a series of cables pivotally connected to the gantry at outwardly spaced locations from the tower, and each cable being connected to the top portion of the tower.

3. The invention of claim 1, wherein:

the first location of the cargo comprises a floating ship; and the second location comprises a vessel.

4. A waterborne crane comprising:

a crane barge having a tower extending vertically therefrom;

a horizontal gantry mounted at an intermediate point thereof on the tower;

cargo transfer means mounted on said gantry for horizontal movement between the opposite ends of said gantry through said intermediate point, and including a hoist mechanism;

a first counterweight suspended from one end of the gantry; and a buoyant counterweight barge and a flexible cable connecting the other end of the gantry to said buoyant counterweight barge so that said buoyant counterweight barge provides a counterbalance effect on said waterborne crane through a tension force on said flexible cable when said cargo transfer means is located on one side of said intermediate point, said first counterweight being effective to provide a counterbalance effect on said waterborne crane when said cargo transfer means is on the other side of said intermediate point, said cargo transfer means when located on said other side being effective to relieve said tension force in said flexible cable thereby rendering said buoyant counterweight barge ineffective.

5. The invention of claim 4, wherein:

said buoyant counterweight barge is of substantially greater weight than the balance load, and the gantry is maintained in equilibrium as cargo is lifted and moved by compensation for weight transfer through the adjustment of tension on the cable.

* * * * *